US006375764B1

(12) United States Patent
Ito et al.

(10) Patent No.: US 6,375,764 B1
(45) Date of Patent: Apr. 23, 2002

(54) WEAVING MACHINE MEMBER MADE OF AN ABRASION-RESISTANT STEEL

(75) Inventors: Kenjiro Ito; Teruhiko Suetsugu; Hiroshi Morikawa; Takashi Yamauchi, all of Shin-Nanyo (JP)

(73) Assignee: Nisshin Steel Co., Ltd. (JP)

( * ) Notice: Subject to any disclaimer, the term of this patent is extended or adjusted under 35 U.S.C. 154(b) by 0 days.

(21) Appl. No.: 09/471,957

(22) Filed: Dec. 23, 1999

(30) Foreign Application Priority Data

Dec. 24, 1998 (JP) ..... 10-366296

(51) Int. Cl.[7] ..... C22C 38/28
(52) U.S. Cl. ..... 148/326; 420/70
(58) Field of Search ..... 148/326; 420/70

(56) References Cited

U.S. PATENT DOCUMENTS 2,905,577 A * 9/1959 Harris et al. ..... 148/326
3,901,690 A * 8/1975 Philip et al. ..... 148/9
4,985,092 A * 1/1991 Kaede et al. ..... 148/326
5,916,517 A * 6/1999 Hackl et al. ..... 148/326

* cited by examiner

*Primary Examiner*—Deborah Yee
(74) *Attorney, Agent, or Firm*—Webb Ziesenheim Logsdon Orkin & Hanson, P.C.

(57) ABSTRACT

A newly proposed steel consists of 8.0–35.0 wt. % Cr, 0.05–1.20 wt. % C, 0.05–3.0 wt. % at least one of Ti, Nb, Zr, V and W and the balance being essentially Fe and has the structure that a total amount of Ti, Nb, Zr, V and/or W carbide precipitates distributed in a steel matrix is adjusted to 0.1 wt. % or more. The steel is bestowed with excellent abrasion-resistance by distribution of carbide precipitates. These carbides have nearly the same hardness as hard particles such as alumina and silicon carbides which causes abrasive abrasion. Due to such excellent abrasion-resistance, a weaving machine member, a sewing needle, an agricultural machine member such as a mowing tooth or a cutter blade made of the steel can be used over a long period.

1 Claim, 2 Drawing Sheets

Relationship Between A Total Amount Of Carbide Precipitations

WEAVING MACHINE MEMBER MADE OF AN ABRASION-RESISTANT STEEL

Field OF THE INVENTION

The present invention relates to a steel which exhibits excellent abrasion-resistance and corrosion resistance in a state exposed to abrasive abrasion and a weaving machine member, e.g. a flat steel heald, a dropper, a reed dent or a tunnel reed, which is likely abraded in contact with fibers.

BACKGROUND OF THE INVENTION

High-strength steels such as cutlery steel or tool steel have been used so far for such uses necessary of abrasion-resistance, e.g. a weaving machine member subjected to abrasion in contact with threads, and an electric or electronic member subjected to abrasion in contact with other members. Corrosion-resistance is also one of requisitions for such steels, accounting use environments.

Although cutters, tools, weaving machine members, electric members or electronic members largely changes their durability in response to use environment, abrasion resistant of steel material puts biggest influence on the durability. In this regard, a carbon steel having a metallurgical structure hardened by quenching or cold-working has been used as a member necessary of abrasion-resistance.

For instance, a structure-hardened steel prepared by quenching a stainless steel SUS420J2 has been used so far as weaving machine members such as a flat steel heald, a dropper, a reed dent and a tunnel reed. Such the weaving machine members are subjected to a severer and severer abrading environment in response to material improvement of fibers used for fabrics and high-speed processing for enhance of productivity. As a result, a lifetime of the members becomes shorter and shorter, and the members are necessarily exchanged for new members with a high frequency.

Since abrasion is the phenomenon which occurs under very complicated mechanisms, causes of abrasion at abraded parts have not been clarified yet, but high-strength steels have been used with estimation of necessary abrasion-resistance. In short, durability of a steel member has been evaluated in the state that the steel member is actually incorporated in an existing machine. As a result, it needs a fairly long time to choose a proper steel kind, and proper selection of the steel kind is also difficult.

Abrasion-resistance of a steel can be improved by structure-hardening or work-hardening. However, abrasive environments is getting more severe in response to enhancement of productivity which needs high-speed processing or use of tough materials to be processed. Such severely abrading environments decrease durability of steel members, resulting in frequent exchange of steel members and occurrence of damages derived from abrasion. The damages derived from abrasion are varied in response to abrading conditions, and hardness is not always proportional to durability of steel members. In this sense, it is important to sufficiently recognize abrading mechanisms in use environments for developments of steel kinds suitable for such environments.

SUMMARY OF THE INVENTION

The present invention is accomplished for fulfillment of such requisitions, aiming at provision of a new steel which sufficiently endures excessive abrasion by dispersion of hard carbide precipitates in a steel matrix and especially at provision of a weaving machine member, which can be used for a long time, made of a steel excellent in abrasion-resistance even under severe abrading conditions.

The newly proposed steel consists essentially of 8.0–35.0 wt. % Cr, 0.05–1.20 wt. % C, 0.05–3.0 wt. % at least one of Ti, Nb, Zr, V and W, and has the structure that an amount of Ti, Nb, Zr, V and/or W carbides precipitates distributed in a steel matrix is adjusted to 0.1 wt. % or more in total.

The weaving machine member according to the present invention is made of a steel essentially consisting of 8.0–35.0 wt. % Cr, 0.05–1.0 wt. % C, up to 1.0 wt. % Si, up to 1.0 wt. % Mn, one or two of 0.05–1.0 wt. % Ti and 0.05–1.50 wt. % Nb with the proviso of 0.05–2.0 wt. % in total and the balance being Fe except inevitable impurities, and having the structure that a total amount of Ti and/or Nb carbide precipitates distributed in a steel matrix is adjusted to 0.1 wt. % or more.

DETAILED DESCRIPTION OF THE PREFERRED EMBODIMENTS

The inventors collected many samples damaged by abrasion as well as test pieces which were subjected to an abrasion test, and have searched the damaged parts in a microscopic viewpoint. Among most of the samples and test pieces, injuries just like grinding scratches were observed at abraded parts. As for samples collected from weaving machine members, injuries just like linear grinding scratches were observed at abraded parts. Adhesion of hard particles such as alumina and silicon carbide was detected near the abraded parts and on surfaces of other members or threads facing to the abraded parts. Such injuries and adhesion of hard particles prove that abrasions occur in co-existence of hard particles. Such abrasion is so-called "abrasive abrasion", wherein a steel member held in contact with another member or threads is scrubbed and ground during vibrating or sliding motion by hard particles present at the contact planes.

The abrasive abrasion is most severe abrasion among various abrasion phenomena. It is urgently requested to offer a material resistant to such abrasive abrasion.

In order to improve abrasion-resistance, the inventors examined a method of quench-hardening a high-carbon steel at first. A weight loss caused by abrasive abrasion was slightly reduced as increase of hardness after quenching, but the quench-hardening did not realize remarkable improvement of abrasive-resistance. That is, the abrasive-resistance can not be sufficiently improved by addition of carbon to harden a steel structure. Improvement of abrasion-resistance was neither realized in a case of a steel hardened by cold-working.

The inventors supposed the reason why endurance of steel materials against abrasive abrasion is not improved by structure-hardening or work-hardening as follows: Hard particles such as alumina and silicon carbide are much harder than a structure-hardened or work-hardened steel member. Since the structure-hardened or work-hardened steel member is not hard enough in comparison with hard particles such as alumina and silicon carbide, the structure-hardening or work-hardening is insufficient for suppression of abrasive abrasion.

Figure 1:
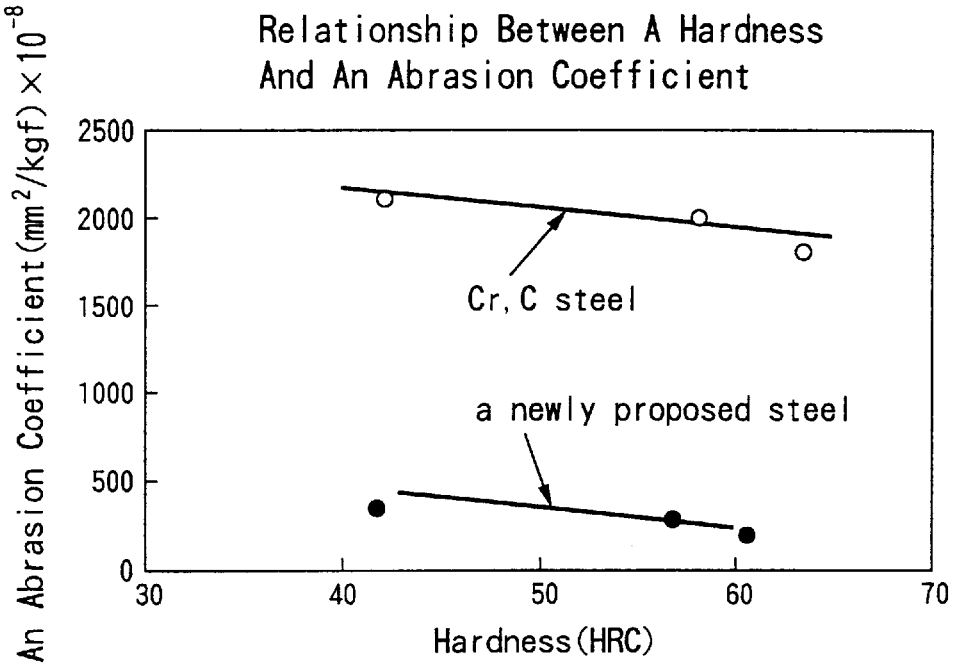
FIG. 1 is a graph illustrating the relationship between hardness and an abrasion coefficient.

During repetition of experiments for researching abrasion mechanisms and a material which sufficiently endures such abrasive abrasion, the inventors discovered that resistance of a steel material to abrasive abrasion is remarkably improved by distribution of hard carbide precipitates in a steel matrix. Concretely, the inventors researched quantitative effects of Ti, Nb, Zr, V and/or W carbide precipitates on endurance to abrasive abrasion from the viewpoint that Ti, Nb, Zr, V and/or W carbides have hardness nearly equal to hard particles such as alumina and silicon carbide. When a sufficient amount of Ti, Nb, Zr, V and/or W carbide precipitates are distributed in the steel matrix, the abrasive abrasion was suppressed, as shown in FIG. 1, compared with steel members having the same hardness but free from such carbide precipitates.

The newly proposed steel contains 8.0–35.0 wt. % Cr. If Cr content is less than 8.0 wt. %, an effect of Cr on corrosion resistance is poor. If Cr content exceeds 35.0 wt. %, hot-workability of the steel is deteriorated resulting in increase of a manufacturing cost.

The steel contains 0.05 wt. % or more of C to precipitate carbides in a total amount of 0.1 wt. % or more. The additive C is not only consumed in generation of carbides, but also effectively strengthens a steel structure. However, an excessive addition of C above 1.20 wt. % promotes quantitative precipitation of huge eutectic Cr carbide which puts harmful influences on quality and hot-workability of the steel.

At least one of Ti, Nb, Zr, V and W is added in an amount of 0.05–3.0 wt. %, so that an amount of Ti, Nb, Zr, V and/or W carbide precipitates in a steel matrix is kept at 0.1 wt. % or more in total. The lower limit 0.1 wt. % of Ti, Nb, Zr, V and/or W carbide precipitates is a critical value which has been discovered by the inventors during researching effects of carbide precipitates on abrasion-resistance. When a total amount of carbide precipitates is kept at 0.1 wt. % or more, the steel exhibits remarkably excellent abrasion-resistance, compared with a steel free from carbide precipitates. Precipitation of Ti, Nb, Zr, V and/or W carbides at 0.1 wt. % or more in a total amount is attained by addition of Ti, Nb, Zr, V and/or W at a ratio of 0.05 wt. %. However, addition of Ti, Nb, Zr, V and/or W in an excessive amount more than 3.0 wt. % causes poor fluidity of a molten steel during a steel-making process, generation of intermetallic compounds which put harmful influences on toughness, and also increase a steel cost.

The steel may contain other elements such as Ni, Mo and Cu. For instance, 0.2–5.0 wt. % Ni is effective for toughness and quench-hardening, 0.1–3.0 wt. % Mo is effective for toughness and corrosion-resistance, and/or 0.2–3.0 wt. % Cu is effective for corrosion-resistance and stress corrosion cracking-resistance. As for other components which are incorporated in the steel C content is preferably adjusted to 0.05–1.50 wt. %, Si content is preferably adjusted to 0.02–2.5 wt. %, and Mn content is preferably adjusted to 0.02–3.0 wt. %.

In a case of a steel for use as a weaving machine member, one or two of 0.05–1.0 wt. % Ti and/or 0.05–1.50 wt. % Nb with the proviso of 0.05–2.0 wt. % are added, so as to keep a total amount of Ti and/or Nb carbide precipitates distributed in a steel matrix at 0.1 wt. % or more. Precipitation of Ti and/or Nb carbides at 0.1 wt. % or more in a total amount is attained by addition of Ti and/or Nb at a ratio of 0.05 wt. %. However, excessive addition of Ti above 1.0 wt. %, Nb above 1.50 wt. % or Ti and Nb above 2.0 wt. % causes poor fluidity of a molten steel during a steel-making process and generation of intermetallic compounds which put harmful influence on toughness.

The steel for use as a weaving machine member may further contain up to 1.0 wt. % Si and up to 1.0 wt. % Mn. Si is added as a deoxidizing agent during a smelting process, but an excessive amount of Si above 1.0 wt. % causes poor toughness. Mn is also added as another deoxidizing agent during a smelting process, but an excessive amount of Mn above 1.0 wt. % increases a ratio of residual austenitic grains during quenching, resulting in deterioration of hardness and toughness.

EXAMPLE 1

Various steels having compositions shown in Table 1 were prepared in a conventional smelting process and cast to slabs. Each slab was subjected to solution treatment and hot-rolled to a thickness of 5 mm. A hot-rolled steel strip was heat-treated 9 hours at 870° C. and then cooled in an oven.

TABLE 1

STEELS USED IN EXAMPLES

| Example | Alloying components and contents (wt. %) | | | | | | | | | | |
|---|---|---|---|---|---|---|---|---|---|---|---|
| No. | C | Si | Mn | Ni | Cr | Ti | Nb | Zr | V | W | NOTE |
| 1 | 0.21 | 0.59 | 0.59 | 0.17 | 9.57 | 0.10 | 0.04 | 0.05 | — | — | PRESENT |
| 2 | 0.30 | 0.62 | 0.64 | 0.15 | 11.58 | 0.19 | 0.02 | — | 0.06 | 0.08 | INVENTION |
| 3 | 0.39 | 0.51 | 0.61 | 0.04 | 12.82 | 0.40 | — | — | — | — | |
| 4 | 0.22 | 0.53 | 0.57 | 0.03 | 13.04 | — | 0.41 | — | — | — | |
| 5 | 0.61 | 0.54 | 0.58 | 0.04 | 13.13 | 0.26 | 0.18 | — | — | — | |
| 6 | 0.29 | 0.58 | 0.61 | 0.21 | 13.43 | 0.31 | 0.25 | 0.15 | 0.12 | — | |
| 7 | 0.68 | 0.57 | 0.65 | 0.19 | 13.48 | 1.12 | — | — | — | — | |
| 8 | 0.34 | 0.51 | 0.62 | 0.17 | 18.52 | 0.13 | 0.17 | — | — | 0.23 | |
| 9 | 0.91 | 0.56 | 0.61 | 0.12 | 23.51 | 0.16 | 1.15 | 0.08 | — | 0.11 | |
| 10 | 1.22 | 0.52 | 0.59 | 0.16 | 31.48 | — | 2.98 | — | — | — | |
| 11 | 0.24 | 0.58 | 0.59 | 0.15 | 1.35 | — | — | — | — | — | COMPARATIVE |
| 12 | 0.21 | 0.52 | 0.61 | 0.04 | 5.32 | — | — | — | — | — | EXAMPLES |
| 13 | 0.32 | 0.55 | 0.62 | 0.21 | 6.59 | — | — | — | — | — | |
| 14 | 0.41 | 0.48 | 0.59 | 0.03 | 10.11 | — | — | — | — | — | |

TABLE 1-continued

STEELS USED IN EXAMPLES

| Example No. | Alloying components and contents (wt. %) C | Si | Mn | Ni | Cr | Ti | Nb | Zr | V | W | NOTE |
|---|---|---|---|---|---|---|---|---|---|---|---|
| 15 | 0.59 | 0.54 | 0.58 | 0.03 | 11.93 | — | — | — | — | — | |
| 16 | 0.68 | 0.54 | 0.64 | 0.17 | 13.48 | 0.03 | 0.03 | — | 0.01 | — | |
| 17 | 1.26 | 0.59 | 0.61 | 0.15 | 13.52 | 0.04 | 0.04 | 0.01 | — | 0.02 | |

Test pieces for an abrasion test were cut off each annealed hot-rolled steel strip, heated 15 minutes at 1100° C. and then cooled to a room temperature. Carbide precipitates distributed in each test piece was quantitatively measured, and endurance of each test piece against abrasive abrasion as well as its corrosion resistance were examined as follows.

Measurement Of An Amount Of Carbide Precipitates

A test piece containing carbide precipitates at a ratio controlled by solution treatment and precipitation treatment was dipped in an alcoholic iodide solution and dissolved therein by ultrasonic irradiation. An amount of carbides remaining in the solution was measured. States of carbides were identified by X-ray diffraction, and amounts of individual metallic elements were measured by wet analysis and gas analysis.

Evaluation Of Weight Loss By Abrasive Abrasion-Resistance

Endurance against abrasive abrasion was testified using a pin-on-disc type frictional wear testing machine. A columnar test piece having a contact surface of 5 mm in diameter was fixed to a pin, while an abrasive paper to which silicon carbide particles were applied was stuck to a disk. The test piece at the pin was charged with a load F (=4000 gf) and scrubbed with the rotating disc at a friction speed of 0.7 m/seconds along a distance L (=0.5 km). Thereafter, a weight loss W ($mm^3$) of the test piece was measured. An abrasion coefficient C was calculated from the measured value according to the formula of $C=W/(L\times F)$ for evaluation of abrasion-resistance.

Evaluation Of Corrosion Resistance

Corrosion resistance of the test piece was evaluated from generation of rusts on a surface of the test piece, after the test piece was subjected 72 hours to a 5% salt water spray test.

Test results are shown in Table 2.

Rusts were generated on a surface of any test piece of Comparative Examples 11 to 13 whose Cr content was less than 8 wt. %, but generation of rusts was not observed on a surface of any test piece of Examples 1 to 10 and also Comparative Examples 14 to 17. It is recognized from these results that Cr content of 8 wt. % or more is necessary for insurance of corrosion-resistance.

Figure 2:
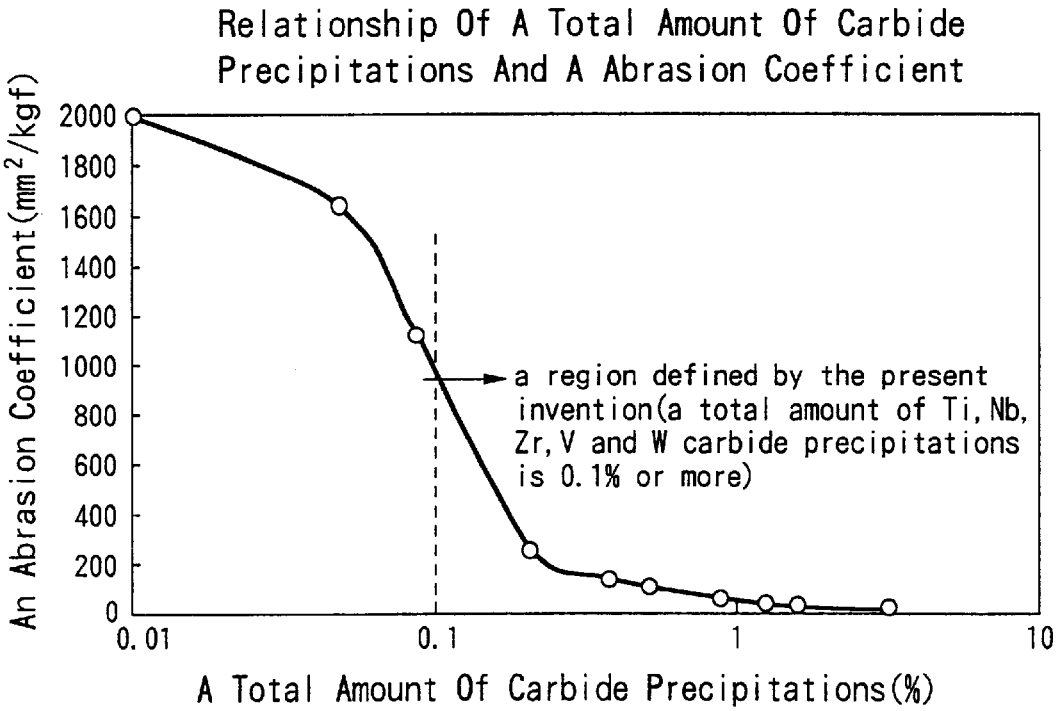
FIG. 2 is a graph illustrating an effect of a total amount of carbide precipitates on an abrasion coefficient.

An abrasion coefficient C was a big value above 18 $mm^2/kgf\times10^{-8}$, as for any test piece of Comparative Examples 11 to 15 free from distribution of carbide precipitates. Since the tendency that the abrasion coefficient C became smaller as increase of carbide precipitates was noted, the inventors graphically illustrated the total amount of carbide precipitates in relation with the abrasion coefficient C and confirmed presence of the relationship as shown in FIG. 2. That is, the abrasion coefficient C is decreased as increase of the total amount of carbide precipitates and surprisingly decreased when the total amount of carbide precipitates was 0.05 wt. % or more. The abrasion coefficient C was decreased to a value below 1000 $m^2/kgf\times10^{-8}$ by adjusting the total amount of carbide precipitates to 0.1 wt. % or more. Such the lower value is less than a half of the abrasion coefficient of a test piece free from carbide precipitates, and is the evidence that the newly proposed steel is excellent in abrasion resistance.

TABLE 2

EFFECTS OF TOTAL AMOUNTS OF CARBIDE PRECIPITATES ON ABRASION COEFFICIENTS

| Example No. | a total amount of carbide precipitates wt. % | an abrasion coefficient $mm^2/kgf \times 10^{-8}$ | corrosion resistance |
|---|---|---|---|
| | PRESENT INVENTION | | |
| 1 | 0.21 | 250 | no rusts |
| 2 | 0.38 | 139 | |
| 3 | 0.46 | 116 | |
| 4 | 0.43 | 124 | |
| 5 | 0.50 | 107 | |
| 6 | 0.91 | 59 | |
| 7 | 1.28 | 42 | |
| 8 | 0.52 | 103 | |
| 9 | 1.63 | 30 | |
| 10 | 3.26 | 15 | |
| | COMPARATIVE EXAMPLES | | |
| 11 | 0 | 2006 | generation of rusts |
| 12 | 0 | 2112 | |
| 13 | 0 | 1998 | |
| 14 | 0 | 1985 | no rusts |
| 15 | 0 | 1805 | |
| 16 | 0.05 | 1650 | |
| 17 | 0.09 | 1125 | |

A total amount of carbide precipitation is a summary of Ti, Nb, Zr, V and W carbide precipitations.
An abrasion coefficient of 1000 $mm^2/kgf \times 10^{-8}$ is regarded as an acceptable avalue.

EXAMPLE 2

Various steels having compositions shown in Table 3 were prepared in a conventional smelting process and cast to slabs. Each slab was subjected to solution treatment and hot-rolled to a thickness of 5 mm. A hot-rolled steel strip was heat-treated 9 hours at 870° C. and then cooled in an oven. The annealed steel strip was pickled with an acid, and then formed to a cold-rolled steel strip of 0.30 mm in thickness by repetition of cold-rolling and annealing.

TABLE 3

STEELS USED IN EXAMPLES

| Example No. | Alloying components and contents (wt. %) C | Si | Mn | Ni | Cr | Ti | Nb | Note |
|---|---|---|---|---|---|---|---|---|
| 1 | 0.23 | 0.55 | 0.57 | 0.16 | 9.92 | 0.12 | 0.11 | Present Invention |
| 2 | 0.31 | 0.59 | 0.61 | 0.14 | 10.53 | 0.22 | 0.12 | |
| 3 | 0.33 | 0.61 | 0.59 | 0.19 | 13.26 | 0.59 | 0.41 | |
| 4 | 0.65 | 0.53 | 0.59 | 0.19 | 13.12 | 1.25 | 0 | |
| 5 | 0.32 | 0.56 | 0.63 | 0.17 | 13.52 | 0 | 1.06 | |
| 6 | 0.88 | 0.51 | 0.59 | 0.14 | 13.56 | 0.71 | 0.76 | |
| 7 | 1.21 | 0.54 | 0.62 | 0.16 | 18.48 | 1.63 | 0.59 | |
| 8 | 0.32 | 0.51 | 0.59 | 0.17 | 4.31 | 0.008 | — | Comparative Examples |
| 9 | 0.62 | 0.49 | 0.58 | 0.15 | 13.37 | 0.04 | 0.02 | |
| 10 | 1.19 | 0.52 | 0.64 | 0.19 | 13.49 | 0.04 | 0.04 | |
| 11 | 0.33 | 0.44 | 0.56 | 0.11 | 13.41 | — | — | SUS420J2 |

Test pieces for an abrasion test were cut off each cold-rolled steel strip and formed to a flat steel heald as a weaving machine member. Each test piece was held 1 minute at 1050° C. in a non-oxidizing atmosphere and then cooled to a room temperature.

An amount of carbide precipitates in each test piece were measured, and corrosion resistance of the test piece was testified in the same way as in Example 1. Abrasion-resistance was evaluated as follows.

In the abrasion test, a synthetic fiber thread (TFD75/36F, 120 $\mu$m in diameter) was run through a mail hole of a flat steel heald as a test piece, and the flat steel heald is abraded in contact with the thread under the conditions the flat steel heald was rotated 10 hours at 800 r.p.m. (a sliding speed of 0.1 m/second) while a tension of 50 g was applied to the thread. Thereafter, a depth of an abrasion at the contact surface was measured, and a weight loss of the mail part abraded in contact with the thread was also measured. Abrasion-resistance of each test piece was evaluated from a value M (%) ($=D_i/D_0\times100$) which was calculated as a ratio of an abrasion depth $D_i$ of each test piece to an abrasion depth $D_0$ of a stainless steel SUS420J2 as a reference. A value M of 50% or less is necessary in order to obtain excellent abrasion-resistance two times higher than a conventional flat steel heald made of a stainless steel SUS420J2.

Test results are shown in Table 4.

Rusts were generated on a surface of a test piece of Comparative Example 8 whose Cr content was less than 8.0 wt. %, but generation of rusts was not observed on a surface of a any test piece of the other Examples whose Cr content is 8.0 wt. % or more. It is recognized from these results that Cr content of 8.0 wt. % or more is necessary for insurance of corrosion-resistance. The value M of any Examples 8 to 10, in which Ti and Nb carbide precipitates were distributed at a ratio less than 0.1 wt. % in total, was not so much smaller, compared with a conventional member (Example 11). On the other hand, any test piece of Examples 1 to 7, in which a total amount of Ti and Nb carbide precipitates were distributed at a ratio of 0.1 wt./% or more, had the value M below 30%. Such the lower value M means the lifetime of a flat steel heald made of the newly proposed steel three times longer than a conventional flat steel heald.

Figure 3:
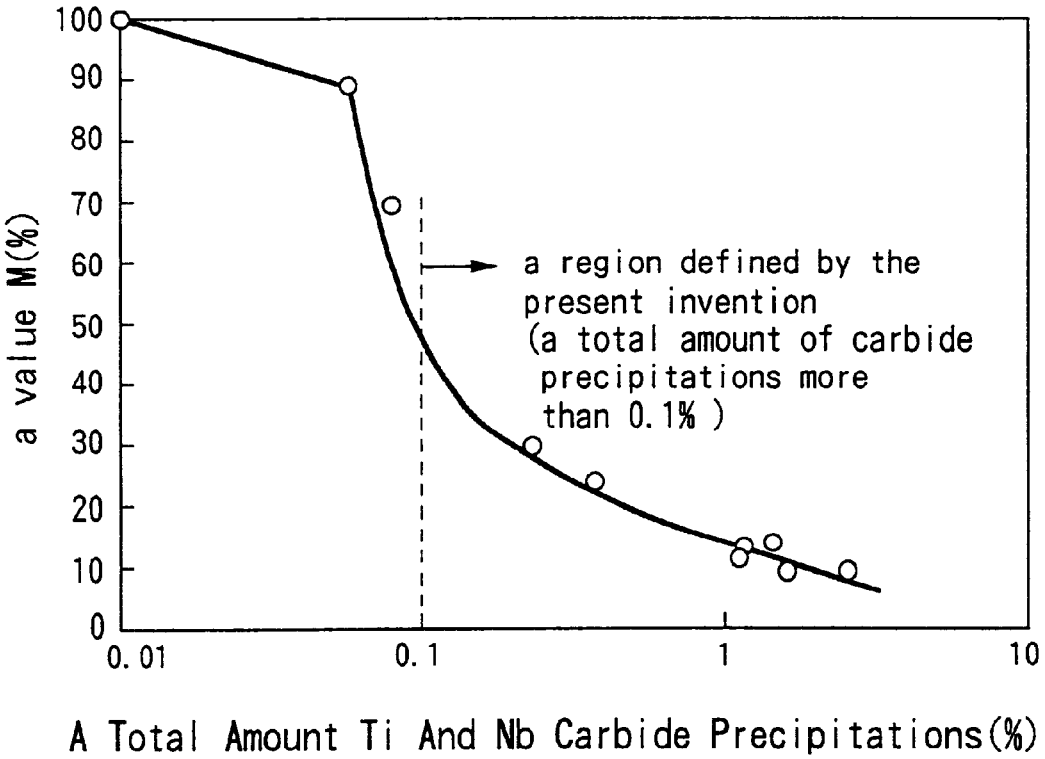
FIG. 3 is a graph illustrating an effect of a total amount of Ti and Nb carbide precipitates on abrasion-resistance.

The inventors graphically illustrated a value M in relation with a total amount of Ti and Nb carbide precipitates, and confirmed presence of the relationship therebetween as shown in FIG. 3. It is apparently noted from FIG. 3 that the value M is decreased as increase of the total amount of Ti and Nb carbide precipitates, and that abrupt decrease of the value M occurs when the total amount of carbide precipitates is 0.1 wt. % or more. The value M is decreased to 50% or less by adjusting the total amount of carbide precipitates to 0.1 wt. % or more. Such the small value M means a lifetime of a flat steel heald made of the newly proposed steel two times longer than a conventional flat steel heald.

TABLE 4

AN AMOUNT OF CARBIDE PRECIPITATES, ABRASION-RESISTANCE AND CORROSION-RESISTANCE OF EACH FLAT STEEL HEALD

| Example No. | an amount of carbide precipitates (wt. %) TiC | NbC | in total | abrasion-resistance a value M (%) | corrosion-resistance | Note |
|---|---|---|---|---|---|---|
| 1 | 0.13 | 0.10 | 0.23 | 29.5 | no rust | Present Invention |
| 2 | 0.26 | 0.10 | 0.36 | 23.2 | no rust | |
| 3 | 0.70 | 0.44 | 1.14 | 12.6 | no rust | |
| 4 | 1.41 | 0 | 1.41 | 13.1 | no rust | |
| 5 | 0 | 1.11 | 1.11 | 11.1 | no rust | |
| 6 | 0.81 | 0.80 | 1.61 | 9.2 | no rust | |
| 7 | 1.90 | 0.59 | 2.49 | 8.5 | no rust | |
| 8 | 0.01 | 0 | 0.01 | 99.1 | generation of rust | Comparative Examples |
| 9 | 0.04 | 0.02 | 0.06 | 89.2 | no rust | |
| 10 | 0.05 | 0.03 | 0.08 | 69.5 | no rust | |
| 11 | 0 | 0 | 0 | 100 | no rust | SUS420J2 |

According to the present invention as above-mentioned, the newly proposed steel is bestowed with excellent abrasion-resistant fairly superior to a conventional structure-hardened or work-hardened steel, by distribution of Ti, Nb, Zr, V and/or W carbide precipitates at a ratio of 0.1 wt. % in total in a steel matrix. These carbides have nearly the same hardness as hard particles such as alumina and silicon carbides which causes abrasive abrasion. Due to such excellent abrasion-resistance, a weaving machine member, a sewing needle, an agricultural machine member such as a mowing tooth or a cutter blade made of the steel can be used over a long period. Especially, the steel, in which Ti and/or Nb carbide precipitates are distributed at a ratio of 0.1 wt. % or more in total, is suitable as a weaving machine member such as a flat steel heald, a dropper, a reed dent or a tunnel reed due to excellent abrasion-resistance.

What is claimed is:

1. A weaving machine member made of a fiber abrasion- and corrosion-resistant steel consisting essentially of:

8.0 to 35.0 weight percent Cr;

0.05 to 1.20 weight percent C;

up to 1.0 weight percent Si;

up to 1.0 weight percent Mn;

at least one of:

(i) 0.05 to 1.0 weight percent Ti, and (ii) 0.50 to 1.50 weight percent Nb, provided that the total combined weight percentages of (i) and (ii) ranges from 0.05 to 2.0 weight percent;

with the balance being essentially Fe;

wherein said Ti, and/or Nb are present in the form of carbide precipitates distributed within a steel matrix in an amount of at least 0.1 weight percent.

* * * * *

UNITED STATES PATENT AND TRADEMARK OFFICE

CERTIFICATE OF CORRECTION

PATENT NO. : 6,375,764 B1
DATED : April 23, 2002
INVENTOR(S) : Ito et al.

It is certified that error appears in the above-identified patent and that said Letters Patent is hereby corrected as shown below:

Title page,
Item [30], Foreign Application Priority Data,
insert -- Dec. 24, 1998 (JP)……...10-366297 --

Signed and Sealed this

First Day of October, 2002

*Attest:*

*Attesting Officer*

JAMES E. ROGAN
*Director of the United States Patent and Trademark Office*